US005234236A

United States Patent [19]

Gromotka

[11] Patent Number: 5,234,236

[45] Date of Patent: Aug. 10, 1993

[54] PAWL ASSEMBLY

[75] Inventor: Gabriel Gromotka, Caledonia, N.Y.

[73] Assignee: Southco, Inc., Concordville, Pa.

[21] Appl. No.: 985,608

[22] Filed: Dec. 3, 1992

[51] Int. Cl.[5] ..... E05C 5/02

[52] U.S. Cl. ..... 292/194; 292/197; 292/62; 411/124; 411/169

[58] Field of Search ..... 292/57, 62, 61, 65, 292/66, 194, 202, DIG. 60, 64; 411/83, 123, 133, 124, 169, 973; 70/370

[56] References Cited

U.S. PATENT DOCUMENTS

| | | | |
|---|---|---|---|
| 1,261,130 | 4/1918 | Jasper | 411/133 |
| 2,860,904 | 11/1958 | Barry et al. | 292/57 |
| 3,212,746 | 10/1965 | Wright | 411/417 |
| 3,402,958 | 9/1968 | Barry | 292/62 |
| 4,556,244 | 12/1985 | Bisbing | 292/65 |
| 4,583,775 | 4/1986 | Bisbing | 292/64 |
| 4,635,891 | 1/1987 | McDonough | 411/417 X |
| 4,763,935 | 8/1988 | Bisbing | 292/66 |
| 4,878,367 | 11/1989 | Bisbing | 70/491 |

OTHER PUBLICATIONS

Southco Fasteners Handbook 40, 1990, pp. D-23, D-24, D-27, E-20, F-6, F-8, J-8.

*Primary Examiner*—Richard E. Moore
*Attorney, Agent, or Firm*—Paul & Paul

[57] ABSTRACT

A pawl assembly comprising a threaded shaft of noncircular cross section, a pawl of generally elongate shape having a circular through hole, and a clip that is nonrotatably mounted on the shaft and which contacts the pawl to prevent rotation thereof. The clip has a noncircular through hole that corresponds to the noncircular cross section of the shaft and a bent portion that contacts a side surface of the pawl to prevent rotation. By using such a clip, the pawl can be oriented in multiple angular directions while also providing for precise axial placement on the shaft. The pawl assemblies may be used in latches for cabinets and the like.

13 Claims, 2 Drawing Sheets

PAWL ASSEMBLY

BACKGROUND OF THE INVENTION

1. Field Of The Invention

The present invention relates to pawl assemblies that may be used in latches or fasteners for doors, panels and the like. In particular, the pawl assemblies comprise an elongated pawl that is prevented from rotation on a shaft through the use of a specially adapted clip.

2. Background Of The Invention

Various types of pawl assemblies are known. U.S. Pat. Nos. 4,556,244, 4,583,775, 4,763,935 and 4,878,367 disclose assemblies in which a pawl is prevented from rotating on a shaft by providing a noncircular hole in the pawl that conforms to a noncircular cross-section of the shaft. Nuts are threaded on the shaft on either side of the pawl to fix the axial location of the pawl on the shaft. With this type of assembly, the number of different angular orientations of the pawl is limited by the shape of the shaft cross section and the corresponding shape of the hole in the pawl. For example, the assemblies disclosed in the above patents are limited to two angular pawl positions located 180° apart due to the configuration of the shaft and through hole.

Another type of conventional assembly includes a pawl having a circular hole that may be threaded onto a bolt. Nuts are threaded on the bolt on each side of the pawl and are tightened against the pawl to prevent rotation thereof. This type of assembly suffers from the drawback that loosening of the nuts may cause unwanted rotation of the pawl. Furthermore, for a given angular orientation of the pawl, axial location is dictated by the increments of the thread pitch, allowing for less precise axial positioning of the pawl.

An additional type of known assembly comprises a pawl having a circular hole that is threaded on a bolt, with an additional bolt threaded through the base of the pawl to contact the first bolt. Once the pawl is located on the first bolt in the desired position, the second bolt is tightened to prevent axial and rotational movement. This type of assembly requires a machining operation on the pawl in order to form a threaded hole in the base. In addition, the thickness of the pawl must be increased to accommodate the threaded hole.

The present invention has been developed in view of the foregoing and to overcome the deficiencies of the prior art.

SUMMARY OF THE INVENTION

An object of the present invention is to provide a novel pawl assembly.

Another object of the present invention is to provide a pawl assembly for latches and the like comprising a threaded shaft having a noncircular cross section, a clip mounted on the shaft having a noncircular through hole and a bent portion, and a pawl having a circular through hole and a side surface that contacts the bent portion of the clip to prevent rotation of the pawl on the shaft. Means for securing the pawl against the clip are also provided.

A further object of the present invention is to provide a pawl assembly in which the pawl may be oriented in multiple angular directions through the use of a specially adapted clip.

These and other objects of the present invention will become more readily apparent from the following description.

DETAILED DESCRIPTION OF THE PREFERRED EMBODIMENTS

Figure 1:
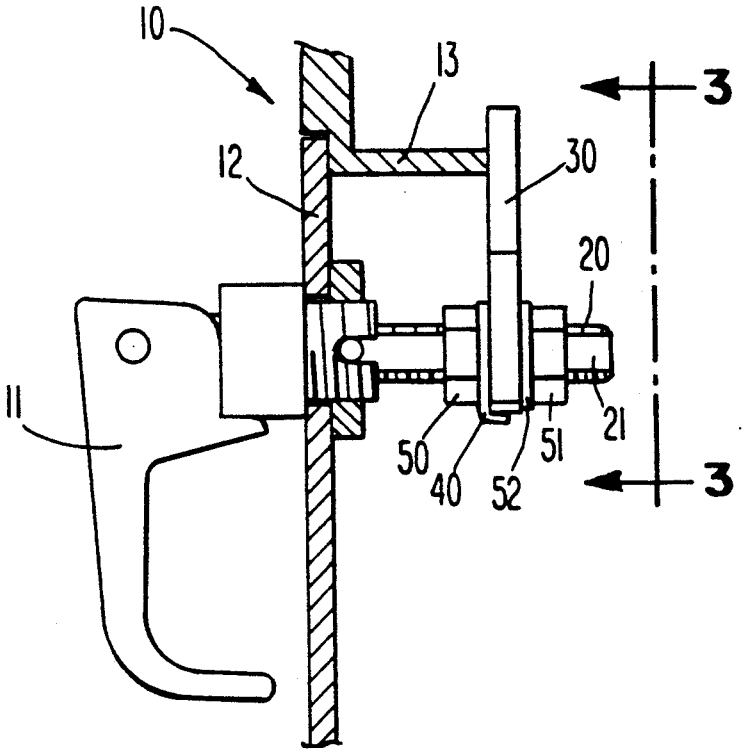
FIG. 1 is a side view of a latch incorporating a pawl assembly of the present invention.

Referring to the drawings in detail, FIG. 1 shows a latch 10 incorporating a pawl assembly of the present invention. The latch includes a handle il and is used to secure a panel 12 to a frame member 13. The handle portion of the latch may be similar to that disclosed in previously cited U.S. Pat. No. 4,763,935, which is hereby incorporated by reference.

The major components of the pawl assembly of the present invention are a threaded shaft 20, a pawl 30 and a clip 40. Fastening means such as nuts 50 and 51 are threaded on the shaft 20 to force the pawl 30 against the clip 40. A lock washer 52 is preferably disposed between the pawl 30 and the nut 51 in order to prevent loosening.

Figure 2:
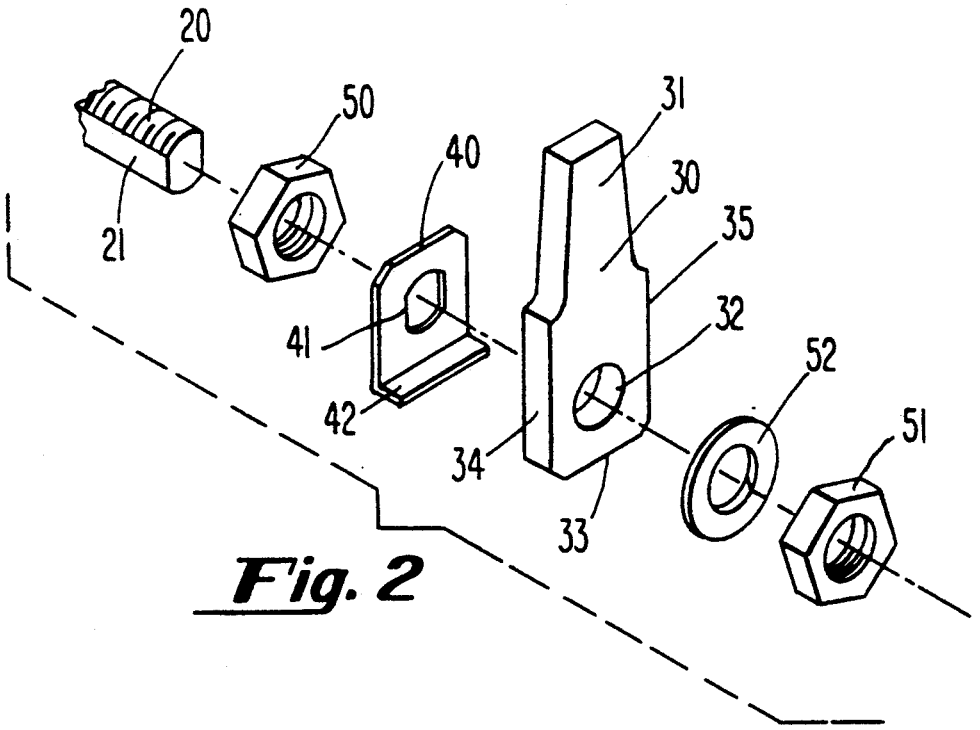
FIG. 2 is an exploded perspective view of the elements of the pawl assembly of the present invention.

As shown most clearly in FIG. 2, the threaded shaft 20 includes a flat portion 21 at opposite sides of the shaft and running along the length of the shaft. The threaded shaft thus possesses a noncircular cross-section. The clip 40 has a noncircular through hole 41 of similar shape to the cross section of the threaded shaft. The clip also includes a bent portion 42 that forms a tab. When placed on the shaft, the clip 40 is prevented from rotating on the shaft due to the corresponding shape of the noncircular through hole 41 and the noncircular cross section of the shaft. The pawl 30 includes an elongated or finger portion 31. Near the base of the pawl is a circular through hole 32, along with side surfaces 33, 34 and 35. When mounted on the shaft 20, the pawl 30 contacts the clip 40 and is prevented from rotating due to contact between the bent portion 42 of the clip and either of the side surfaces 33, 34 or 35. In the orientation shown in FIG. 2, side surface 33 would contact bent portion 42, thus holding the pawl in a vertical orientation. Nuts 50 and 51 and lock washer 52 are disposed on the threaded shaft in order to force the pawl against the clip and to adjust the axial location of the pawl on the threaded shaft.

Figure 3:
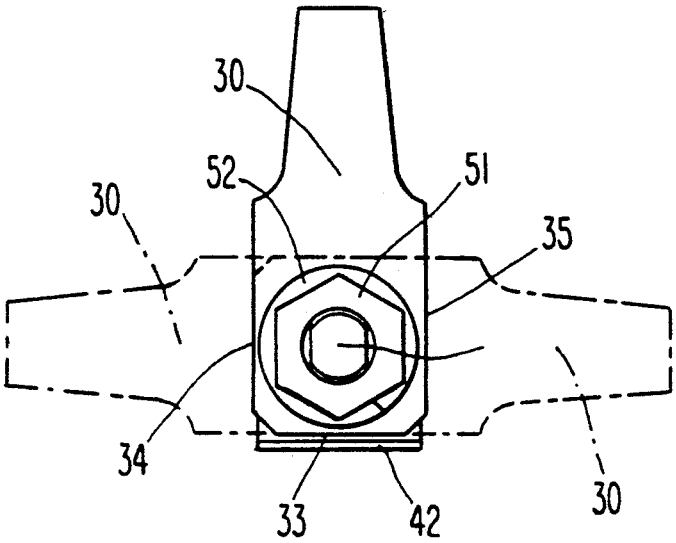
FIG. 3 is an end view of the present pawl assembly taken along line 3—3 of FIG. 1, showing alternate rotational orientations of the pawl in phantom.

FIG. 3 is an end view of the present pawl assembly looking along line 3—3 of FIG. 1. Due to the fact that flat side surfaces 33, 34 and 35 are located at equal distances from the center of the circular through hole, the pawl 30 may be oriented in three different angular positions on the threaded shaft 20 for a given clip orientation. The bent portion 42 of the clip has a flat surface that contacts any of the flat surfaces 33, 34 or 35 to prevent rotation of the pawl. When the side surface 33 contacts the bent portion 42 of the clip, the pawl is oriented vertically as shown by the solid lines of FIG. 3. When either side surface 34 or 35 contacts the bent portion 42, the pawl is oriented horizontally to the left or right as shown in phantom in FIG. 3.

Figure 4:
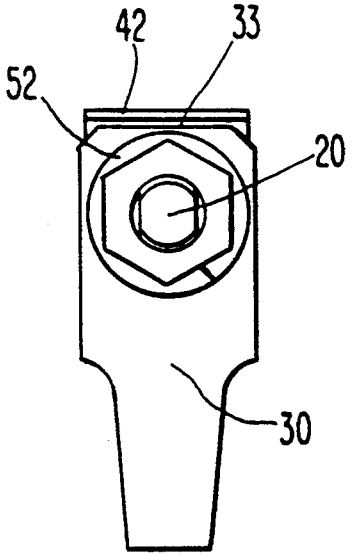
FIG. 4 is an end view of the present pawl assembly showing the pawl in an alternate rotational orientation.

FIG. 4 shows another orientation in which the bent portion 42 of the clip has been rotated 180° on the threaded shaft 20. With the clip in this location, the pawl is oriented downwardly when side surface 33 contacts bent portion 42. Although not shown in FIG. 4, it will be noted that the pawl could also be adjusted to face either the left or right side while maintaining the clip in the same position. Thus, by rotating the clip 180° as illustrated in FIGS. 3 and 4, it is possible to provide four angular orientations of the pawl.

Figure 5:
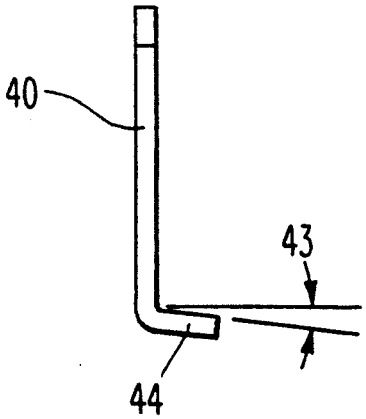
FIG. 5 is a side view of a pawl orienting clip of the present invention.

FIG. 5 is a side view of a preferred clip of the present invention in which the bent portion 44 extends at an angle 43 from the main portion of the clip 40. This angled configuration provides advantages because dimensional tolerances of the clip can vary to some degree while still maintaining an operational assembly. When such an angled bent portion is used, the side surface of the pawl is seated near the root of the bend rather than along the entire surface of the bent portion. An angle 43 of about 5° has been found to be particularly satisfactory.

The pawl assembly of the present invention possesses several advantages over conventional pawl assemblies. A single set of components can be used to provide multiple pawl orientations by using a clip that is nonrotatably mounted on the shaft and in contact with a side surface of the pawl. In accordance with the present invention, a relatively simple assembly is provided that my be adapted to varying latch requirements. For example, the same components may be used in side latching and top latching configurations. The clip of the present invention is relatively inexpensive and can be formed by a simple bending operation. Thus, no complex metal forming operations are necessary to produce the clip. A portion of the clip is merely bent to form a flat tab portion that contacts a side surface of the pawl. Formation of the pawl is also simplified due to the fact that a simple circular through hole may be drilled or otherwise formed in the pawl with no requirement for a complex shape. In addition, the side surfaces of the pawl are easily formed to a shape conforming to that of the bent portion of the clip. While flat surfaces are most preferred, it should be noted that the side surfaces of the pawl could be altered to any satisfactory configuration corresponding to that of the bent portion of the clip. While a pawl having three side surfaces of equal distance from the center through hole is preferred, additional flat surfaces could be provided in order to permit additional orientations of the pawl with respect to the clip.

A particular advantage of the pawl assembly of the present invention is that a single inventory of parts may be used to provide multiple pawl configurations. For example, the same assembly can be used for a side latching cabinet and can then be altered for use in a top latching cabinet. Multiple angular orientations of the pawl may be provided, while also providing exact axial location of the pawl on the threaded shaft. In the preferred embodiment, the circular through hole of the pawl 32 is not threaded and can be placed anywhere along the axial direction of the shaft for any given angular orientation. This is not possible in prior art assemblies in which the pawl is threaded on a shaft and secured by nuts and lock washers. In that type of assembly, axial location for a given angular orientation is limited to increments of the thread pitch.

The pawl assembly of the present invention also possesses advantages over prior art assemblies in which the pawl has a noncircular through hole that is received by a shaft having a corresponding noncircular cross section. In such a configuration, the angular orientation of the pawl is limited by the particular shape of the noncircular through hole. For example, many prior art pawls incorporate through holes comprising opposing flat surfaces and rounded side portions known as double D holes. Such pawls are used in conjunction with threaded shafts of noncircular cross section having similar flat portions conforming to those of the pawl through holes. In such assemblies, the pawl may be oriented in only two directions located 180° apart. In contrast, the pawl assemblies of the present invention are capable of additional orientations. For example, the preferred pawl assembly as shown in FIGS. 1–4 may be oriented in any of four directions located 90° apart. Thus, the same pawl assembly can be used in side latching and top latching cabinets and there is no need to carry separate inventory for these differing latch configurations.

Various modifications of the present assembly are possible. For example, although a flat pawl is shown in FIGS. 1–4, offset pawls having bent portions are possible. The bent portion of the pawl may extend either toward or away from the handle portion of the latch, with varying amounts of offset being possible Furthermore, the shape of the shaft cross section and clip through hole as shown in FIG. 2 can be altered to any noncircular shape that satisfactorily prevents rotation of the clip on the shaft. In addition, the pawl assemblies of the present invention may be used in many more devices than the latch assembly shown in FIG. 1 Accordingly, it is understood that the above description of the present invention is susceptible to considerable modifications, changes and adaptations by those skilled in the art, and that such modifications, changes and adaptations are intended to be considered within the scope of the present invention which is set forth by the appended claims.

We claim:

1. A pawl assembly comprising:

a) a threaded shaft having a noncircular cross section;

b) a clip having a noncircular through hole and a bent portion, wherein the clip is nonrotatably mounted on said shaft through contact between said noncircular through hole and said shaft;

c) a pawl of generally elongate shape having a circular through hole located near one end thereof and at least one side surface adapted to contact said bent portion of said clip, wherein contact between said side surface and said bent portion prevents rotation of said pawl in relation to said shaft; and d) means provided in contact with said shaft for securing said clip against said pawl.

2. A pawl assembly according to claim 1, wherein said noncircular cross section of said shaft includes two opposing flat portions.

3. A pawl assembly according to claim 2, wherein said noncircular through hole of said clip includes two opposing flat portions that contact said two opposing flat portions of said shaft.

4. A pawl assembly according to claim 1, wherein said clip is adapted to be mounted on said shaft in at least two angular positions.

5. A pawl assembly according to claim 1, wherein said bent portion of said clip extends in a direction substantially parallel to the axis of said shaft.

6. A pawl assembly according to claim 1, wherein said bent portion of said clip extends in a direction at an angle to the axis of said shaft.

7. A pawl assembly according to claim 1, wherein said bent portion of said clip has a substantially flat surface.

8. A pawl assembly according to claim 7, wherein said at least one side surface of said pawl is substantially flat and contacts said substantially flat surface of said bent portion.

9. A pawl assembly according to claim 1, wherein said pawl comprises at least two of said side surfaces located at substantially equal distances from said circular through hole, allowing said pawl to be mounted on said shaft in at least two angular positions.

10. A pawl assembly according to claim 1, wherein said pawl comprises two flat side surfaces located at substantially equal distances from said circular through hole and at a substantially right angle to each other.

11. A pawl assembly according to claim 1, wherein said pawl comprises three flat side surfaces located at substantially equal distances from said circular through hole, with two of the surfaces being substantially parallel to each other and the third surface disposed at substantially rights angles to the other two surfaces.

12. A pawl assembly according to claim 1, wherein said means for securing said clip against said pawl comprises a first nut threaded on said shaft and contacting said clip, and a second nut threaded on said shaft and contacting said pawl.

13. A pawl assembly according to claim 12, wherein a lock washer is disposed between said second nut and said pawl.

* * * * *

UNITED STATES PATENT OFFICE

CERTIFICATE OF CORRECTION

Patent No. 5,234,236 Dated August 10, 1993

Inventor(s) Gabriel Gromotka, Caledonia, N.Y.

It is certified that error appears in the above-identified patent and that said Letters Patent is hereby corrected as shown below:

Column 2, line 22, "includes a handle il and is used to" should read -- includes a handle 11 and is used to --.

Column 4, line 29, "being possible Furthermore" should read -- being possible. Furthermore" --.

Column 4, line 35, "shown in FIG. 1 Accordingly" should read -- shown in FIG. 1. Accordingly --.

Signed and Sealed this

Fifteenth Day of March, 1994

Bruce Lehman

*Attest:*

BRUCE LEHMAN

*Attesting Officer*

*Commissioner of Patents and Trademarks*